United States Patent [19]

Payson

[11] 3,983,650

[45] Oct. 5, 1976

[54] PORTABLE CHART HOLDER

[76] Inventor: William Francis Payson, Old Jaffrey Road, Peterborough, N.H. 03458

[22] Filed: Mar. 17, 1976

[21] Appl. No.: 667,901

[52] U.S. Cl. ..... 40/152
[51] Int. Cl.[2] ..... B09F 1/12
[58] Field of Search ..... 40/152, 154, 10 R

[56] References Cited

UNITED STATES PATENTS 1,031,727 7/1912 Mussbeck ..... 40/152

*Primary Examiner*—Louis G. Mancene
*Assistant Examiner*—John H. Wolff
*Attorney, Agent, or Firm*—Russell & Nields

[57] ABSTRACT

A portable chart holder for use in open or exposed positions which provides protection from the elements and easy visual reference to contained charts is disclosed. The chart holder generally comprises a base panel surrounded by and integrally locked into a frame, a transparent cover designed to fit the configuration of the base panel-frame assembly such that a chart containing enclosure is formed between the base panel and the cover, and easily disengagable fastening means disposed at intervals about the periphery of the cover adapted to removably affix the cover to the frame such that the chart containing enclosure is substantially isolated from the effects of the elements.

7 Claims, 3 Drawing Figures

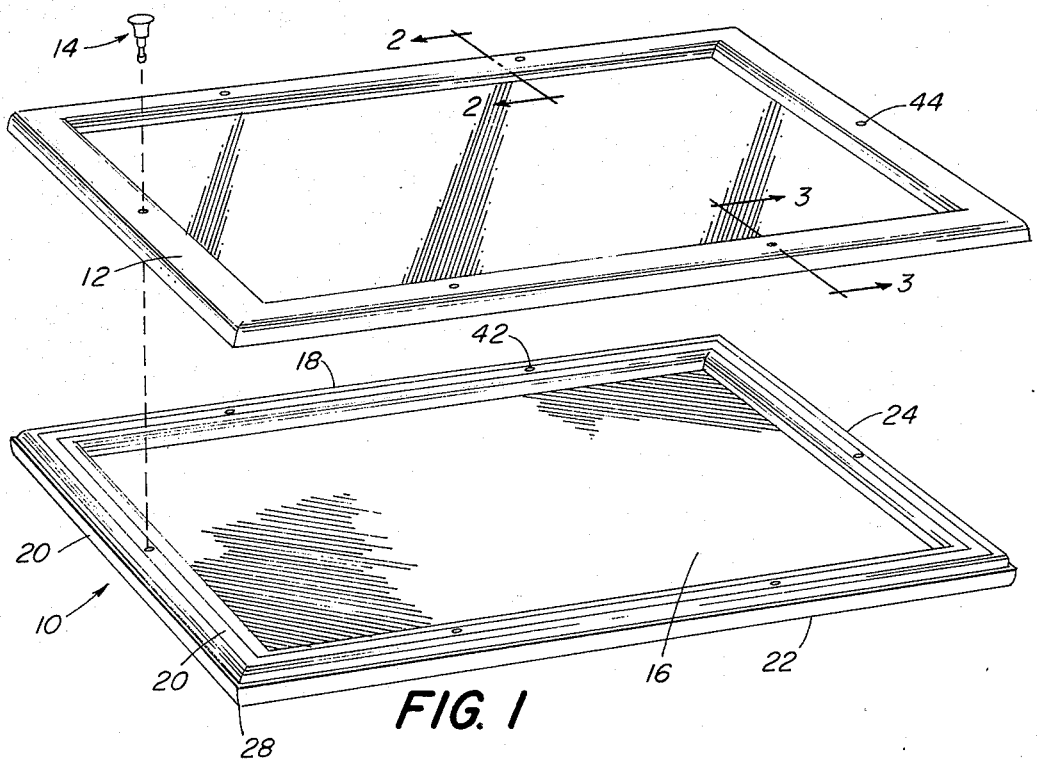
FIG. 1
FIG. 2
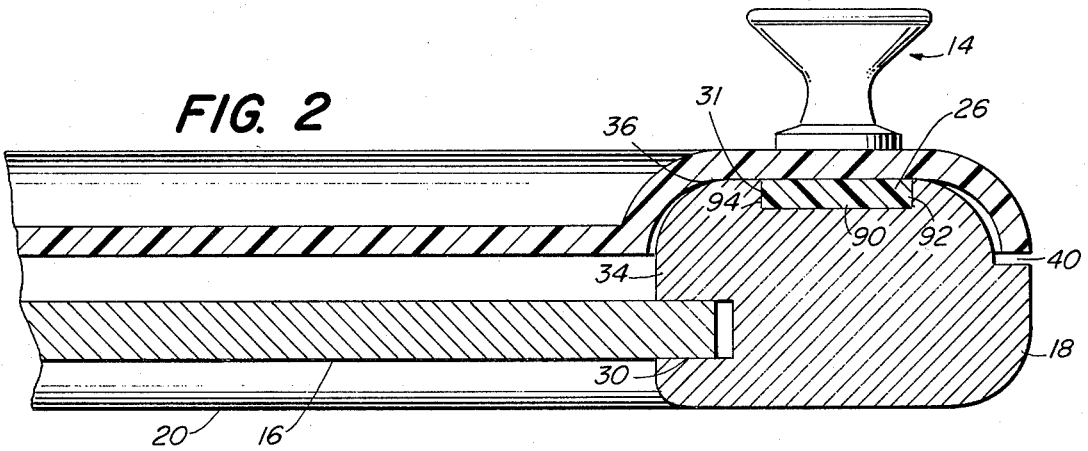
FIG. 3
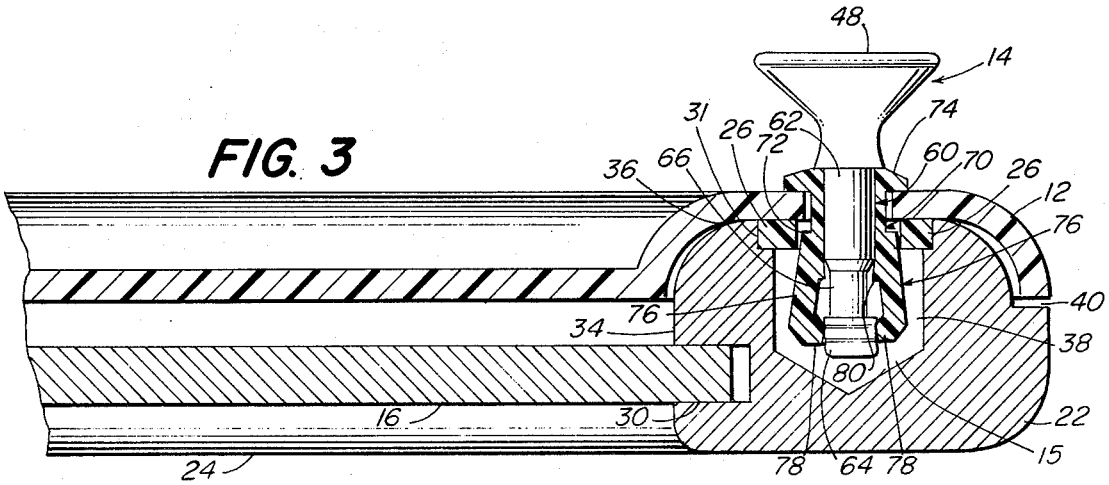

PORTABLE CHART HOLDER

BACKGROUND

This invention relates to a holder for nautical charts designed to protect the charts from the elements — wind, spray, and rain; and yet provide easy visual reference. Since the inception of this invention its primary contemplated use has been in the context of "open cockpit boats," but its application is not limited to boats in this category, as will be explained below. The term "open cockpit boat" as used herein means those craft generally included in the category of day sailors and those which have little or no protection against the weather other than perhaps a windshield or a light canvas top. Such craft are normally simply sailed or driven (i.e., controlled with respect to course and position by visual reference to land or navigational aids such as beacons and buoys), rather than navigated in the sense that one's course and position are determined by computations and the plotting of fixes upon charts. Consequently, the present invention is designed for use with piloting charts or those navigation charts which already have all necessary notations thereon. The present invention makes no provision for the making of navigation computations and/or notations directly on the face of the cover.

It is well known that the studying of a navigation chart of any kind in an open cockpit boat, or for that matter in any vessel wherein the helmsman is in an open or exposed position, while under way is difficult even under the best conditions, and that in foul weather it is next to impossible. Take for example the case of an open cockpit boat which after a day's run approaches an unfamiliar harbor at dusk in a light rain. The harbor channel is marked; however, in order to follow the markings correctly, frequent reference to a nautical chart is necessary. At this point a number of serious difficulties for the craft's operator, especially if he is alone, become clear. (1) The rain, the darkness, and the cumbersome size of such charts all tend to make accurate reading difficult, (2) The rain and spray tend to blur the chart and will eventually ruin it, (3) Nautical charts are usually merely paper and thus cannot be put down in order to free the operator's hands for other duties without the chance that a sudden gust of wind will result in the loss of the chart overboard with consequent danger to the craft and its passengers, and (4) Such charts lack the rigidity to be effectively usable except in a repeatedly folded single hand-holdable state.

Various means have been employed in an attempt to cope with the above problems. For example, plastic pouches, some secured to the craft and some not, have been used. Such pouches do protect the chart from weather and spray, and if secured to the craft also protect against loss. The problem with such a pouch however is its inconvenience. The chart must be removed for use and returned after each use for protection. In a complex piloting situation requiring frequent reference to the chart such a pouch would clearly not be used for its intended purpose, so the basic problems discussed above remain for these periods at least.

Another possible solution used by some sailors is to cut out and paste a section of chart on a piece of plywood and to coat the unit thus created with shellac to make it water repellant. At first blush this solution appears satisfactory. The chart is protected from the elements, portable and is of sufficient weight so as not to be blown overboard; moreover, the chart is displayed flat and the plywood board may be placed in any desired position, both of these being features which facilitate use.

This solution is fine as far as it goes, but it has no flexibility. The size of coast and geodetic charts varies, and in some cases may run as large as 35½ inches × 47½ inches. A board this large is clearly much too big for convenient use in an open cockpit boat. Experience indicates that a board of approximately 12 inches × 12 inches to 14 inches × 12 inches is the largest size conveniently usable in such craft. This in turn indicates that only approximately one quarter of a total chart may be practically mounted as above. Thus limited, this solution too is unsatisfactory. It is not uncommon for open cockpit boats to make runs along the coast of 70 miles or more for overnight stays, yet the solution indicated above is limited to 1/10 of a single chart area, typically only a few square miles.

It is therefore evident that either each chart carried must be cut and mounted as above (not to mention cataloged for reference), or the operator must put up with the above-recited problems, or a means must be devised providing a solution to the above problems while at the same time providing practical operational flexibility.

SUMMARY OF THE INVENTION

It is an object of the present invention to provide a means for accomplishing the last of the above alternatives. Specifically I have found that a portable chart holder comprising a solid base and a transparent cover can be made to fulfill the above recited objective at reasonable cost.

Generally speaking my invention makes use of the fact that the operator of an open cockpit boat will usually fold a chart to about 1/10 of its total size for practical use, refolding periodically as necessary so as operationally to reveal only so much of the chart as is directly useful to him during any particular period of time. The invention consists of a base panel surrounded by and integrally locked into a frame; a folded chart is placed upon the back panel inside the inner walls of the frame, and a transparent cover is placed over both the panel and the frame. The cover is made to fit the configuration of the frame, so that when it is snapped thereto it forms a water-resistant seal. The cover fasteners are easily snapped open to allow refolding of the chart. My invention thus protects a chart from all hazards while facilitating its use.

BRIEF DESCRIPTION OF THE DRAWINGS

These as well as other features, objects, and advantages of the present invention, will be more clearly understood by reference to the following detailed description of the preferred embodiment of the present invention and to the drawings in which:

FIG. 1 is a perspective view of a chart holder in accord with the present invention shown in separated relation to more clearly show each of the elements and its location relative to the assembled unit;

FIG. 2 is a cross-sectional view of an assembled chart holder in accord with FIG. 1 taken along the line 2—2 of FIG. 1;

FIG. 3 is a cross-sectional view of an assembled chart holder in accord with FIG. 1 taken along the line 3—3 of FIG. 1.

DETAILED DESCRIPTION OF THE PREFERRED EMBODIMENT

Referring now to the drawings in which like elements are designated by like reference numerals throughout, FIG. 1 shows the preferred embodiment of the present invention in separated perspective relation. This embodiment is comprised basically of a base unit indicated generally at 10, a cover member 12 and a plurality of quick release fasteners representatively indicated at 14. Each of these elements and its cooperative relationship to each of the others will be discussed in more detail as the instant description proceeds.

The base unit 10 is comprised of a substantially rectangular back panel 16, four frame elements 18, 20, 22 and 24 and a retaining gasket 26. In the preferred embodiment of the present invention the back panel 16 is contemplated to be of marine grade Philipine Mahogany, 16 inches × 12 inches × 3/16 inch; the frame elements 18, 20, 22 and 24 are contemplated to be of Honduras Mahogany, elements 18 and 22 having dimensions 18 inches × 1¼ inches × ¾ inch and elements 20 and 24 having dimensions 14 inches × 1¼ inches × ¾ inch; and the retaining gasket 26 contemplated to be of an opaque acrylic (such as that sold under the trade name "Plexiglas" by Rohm & Haas Co.) having outside dimensions of 17¼ inches × 13¼ inches and being 15/32 inch wide by 1/10 inch high. It is further noted that for ease of manufacture the retaining gasket 26 is preferably comprised of four pieces adapted to be placed together along 45° cuts provided in the ends of these pieces (along the 15/32 inch dimension thereof) so that they form a substantially rectangular gasket of the above dimensions.

The frame elements 18, 20, 22 and 24 are contemplated to be assembled in a conventional manner, i.e., by gluing or otherwise joining adjacent frame elements to each other along 45° cuts provided in the ends of these elements (along the 1¼ inch dimension thereof) for this purpose. If desired these joints, representatively shown at 28, may be reinforced with metal brads (not shown); however, in such a case care should be taken to bury such brads in the wood and cover them with plastic, wood or the like in order to avoid problems caused by rust, corrosion and the like which are otherwise contemplated to be nonexistant in the instant invention.

Each such frame element also contains two channel-like grooves 30 and 31 most clearly seen in FIGS. 2 and 3. The grooves 30 in the frame elements 18, 20, 22 and 24 in the assembled frame define a single continuous channel in the lower half of the inner surface 34 of the assembled frame, said channel adapted to receive and hold the back panel 16 with a 1/10 inch swelling clearance. The grooves 31, on the other hand, are certainly located in the upper surface 36 of each frame element and collectively comprise a substantially rectangular channel of substantially rectangular cross section in the upper surface 36 of the assembled frame.

Each such frame element further contains one or more holes representatively shown at 38 of diameter less than the width of grooves 31 drilled into surface 90 between walls 92 and 94 of the grooves 31, and an indented portion 40 along its upper outside corner as shown in FIGS. 2 and 3. The purposes of grooves 31, holes 38, and idented portion 40 will become apparent below.

Given the above features of the frame-back panel configuration, the present invention contemplates that a restraining gasket 26 be adapted to fit securely into the channel defined by grooves 31. The gasket 26 may be held in place by any convenient conventional means whether such be simple friction or a complex bonding or gluing process. Whatever the means used, the gasket 26 must be securely held in place for, as will later become more clearly apparent, this gasket is required to act not only as a seal but as part of the mechanism which maintains the assembled integrity of the chart holder as well.

The gasket 26 itself, as mentioned above, is contemplated to be of substantially rectangular shape and to be of the same height as the depth of grooves 31. Further, it is contemplated that the gasket contain a plurality of holes, shown representatively at 42, of slightly smaller diameter than the holes 38 in the frame elements 18, 20, 22 and 24 and that the holes 42 be positioned on center directly above holes 38.

The cover member 12 is, in the preferred case, of a molded transparent acrylic such as plexiglass having peripheral contours substantially the same as the upper half of the base unit 10, the area above the back panel 16 being a transparent flat acrylic area located approximately 3/16 inch from the back panel. The cover member also has holes, representatively shown at 44, positioned so as to be on center directly above the holes 42 in the gasket 26 and the holes 38 in the grooves 31 of each frame element, but of diameter less than that of either holes 42 or holes 38.

I have found that ultraviolet stabilized acrylic approximately 0.080 inch to 0.090 inch thick is the preferrable material for the cover because continued exposure to the sun will not cause yellowing in such acrylic, and because a cover made of such material is strong enough to withstand normal use yet thin enough not to seriously effect the reading of a chart therethrough.

Before proceeding to the last element, it will probably also be instructive to draw attention to the fact that the cover memeber 12 fits into indented portion 40. This feature is not only aesthetically pleasing but also is practical in that possible catching and tearing of clothes or sails on protruding cover edges is avoided, as are possible lacerations to the hands or arms of a user.

The quick release fasteners 14 are of any commercially available type which when pressed through holes 44 and 42 into hole 38 will hold the cover securely in place and yet be comparatively easily removed. I have found that H. S. Bancroft Corporation in New Jersey makes a polycarbonate/nylon fastener which will serve this purpose well. It is this type fastener which is shown in detail in FIG. 3.

In use therefore one merely selects the chart to be used, folds it so as to fit the internal diameter of the case and to expose the pertinent area, places the chart upon the back panel with the side to be viewed up, and affixes the cover thereover by a simple pressing force exerted upon the fasteners. Later, when either a second chart or another section of the same chart is desired to be used, a simple pulling motion exerted upon the fasteners will release the cover.

Several features of the preferred embodiment provide further advantages not heretofore mentioned. First, the materials chosen, the mold of the plexiglass cover, and the means whereby the unit is secured together interact such that the rain or spray will run off and not effect the enclosed chart. No claim is made that the unit is water tight per se, but tests have shown excellent protection from water in all but the total immersion case. Second, frame elements 18 and 22 and 20 and 24 are in the preferred case mirror images of each other. Consequently, the cover is reversible endwise, thereby removing the necessity of matching an end of the cover with a corresponding end of the base each time the cover is removed from and subsequently replaced thereon. Third, the particular nature of the fasteners chosen combined with the concentric diameters of holes 38, 42 and 44 results in a situation in which the fasteners once inserted, can never be removed from the cover. As is most clearly shown in FIG. 3, each fastener 14 consists of a plunger 60 having a knob 48 at its upper end, adapted for the exertion of both pulling and pushing forces upon the plunger 60, a central rod portion 62, and a lower portion 64 formed by cutting a groove 66 in the lower portion of rod 62 as shown; and a grommet 70 consisting of a central cylinder 72 having a ridge 74 extending radially outward from one end of cylinder 72 and a plurality of core retaining elements 76 axially and resiliently attached at spaced intervals around the other end of cylinder 72 so as to form core retaining snap 80. Core retaining elements 76 also taper inwardly at their ends 78 opposite the point of attachment. Fasteners 14 are sold disassembled. In the present context the diameter of hole 44 in cover member 12 is approximately equal to the outer diameter of cylinder 72. The grommet 70 is inserted through hole 44 by compressing core retaining elements 76. Once so inserted ridge 74 and core retaining elements 76, which expand back to their normal configuration after insertion, hold grommet 70 in place. Plunger 60 is then inserted into cylinder 72 as shown in FIG. 3, the lower portion 64 being snapped into core retaining snap 80. Fastener 14 is so designed that both the plunger 60 and the grommet 70 are now locked in place in cover member 12. Hole 42 in retaining gasket 26 on the other hand is chosen just large enough to allow passage of core retaining elements 76 in their normal nonexpanded state and hole 38 in base 10 is of larger diameter than hole 42. Consequently, once the core retaining elements 76 pass through hole 42 they may be expanded by forcing the lower portion 64 of plunger 60 between the tapered ends 78 of core retaining elements 76 to thereby expand core retaining elements 76 and hold the unit together. A simple reversal of the above allows separation of cover 12 from base 10. Thus, the chart holder of the present invention is of but two pieces — a wooden base and a plexiglass cover — and there is little chance of losing pieces of or a piece falling in the bilges where recovery might be extremely difficult.

It should be understood that the embodiments and practices described and portrayed herein have been presented by way of disclosure, rather than limitation, and that various modifications, substitutions, and combinations may be effected without departure from the spirit and scope of this invention in its broader aspects.

I claim:

1. A portable chart holder for transporting and protecting portable charts from the elements and providing easy visual reference thereto comprising:

a solid substantially rectangular back panel;

a solid wall member of substantially rectangular cross section extending around the periphery of said back panel;

said wall member having an upper surface, a lower surface, an inner surface, and an outer surface, a first longitudinal channel-like groove in said inner surface adapted to receive and hold said back panel, a second longitudinal channel-like groove of shallow depth in said upper surface;

said wall member also defining a plurality of holes in said second groove of diameter less than the width of said second groove extending transversely into said wall member deeper than said second groove;

the junction between said upper surface and said outer surface being indented;

a resilient restraining gasket secured tightly into said second groove;

said restaining gasket being of a height slightly greater then the depth of said second groove and defining a plurality of holes in registry with and of smaller diameter than said holes in said second groove;

a transparent cover member having a peripheral channel of dimensions substantially the same as those of said upper surface adapted to fit over said upper surface and into said indented portion so that said cover member and said back panel are in close but nontouching relation;

said cover member further defining a plurality of holes directly above and of smaller diameter than said holes in said restraining gasket;

and, a plurality of quick release fastener means adapted to be inserted through said holes in said cover and said restraining gasket and into said holes in said groove in said upper surface so that said cover portion is held tightly against restraining gasket.

2. The chart holder of claim 1 wherein said back panel and said wall are made of mahogany.

3. The chart holder of claim 1 wherein said cover member is made of transparent ultraviolet stabilized acrylic.

4. The chart holder of claim 3 wherein said back panel-wall configuration is coated with urethane.

5. The chart holder of claim 1 wherein said quick release fasteners are polycarbonate/nylon.

6. The chart holder of claim 1 wherein the inner surface of the wall member defines a chart area in the range 165 to 260 sq. in.

7. The chart holder of claim 1 wherein each pair of opposing wall portions have respectively the same number of holes in the top edges thereof.

* * * * *